US009014876B2

(12) United States Patent
Mason et al.

(10) Patent No.: US 9,014,876 B2
(45) Date of Patent: Apr. 21, 2015

(54) SYSTEM FOR PROCESSING FLEET VEHICLE OPERATION INFORMATION

(71) Applicant: Telogis, Inc., Aliso Viejo, CA (US)

(72) Inventors: Ralph James Mason, Christchurch (NZ); David John Mitchell, Austin, TX (US); John Thomas Morris, Round Rock, TX (US)

(73) Assignee: Telogis, Inc., Aliso Viejo, CA (US)

( * ) Notice: Subject to any disclaimer, the term of this patent is extended or adjusted under 35 U.S.C. 154(b) by 0 days.

(21) Appl. No.: 13/921,036

(22) Filed: Jun. 18, 2013

(65) Prior Publication Data

US 2013/0338855 A1 Dec. 19, 2013

Related U.S. Application Data

(60) Provisional application No. 61/661,753, filed on Jun. 19, 2012.

(51) Int. Cl.
*G07C 5/08* (2006.01)
*G07C 15/00* (2006.01)
(Continued)

(52) U.S. Cl.
CPC ..... *G07C 5/0816* (2013.01); *G07C 5/008* (2013.01); *G07C 5/085* (2013.01); *G07C 2009/0092* (2013.01)

(58) Field of Classification Search
CPC ..... G07C 5/0816; G07C 5/008; G07C 2009/0092; G07C 5/08; G07C 21/00; G07C 5/085; G06Q 10/06311; G08G 1/123
USPC ..... 701/2, 29.3, 29.1, 30.5, 33.4, 36
See application file for complete search history.

(56) References Cited

U.S. PATENT DOCUMENTS 6,430,164 B1 8/2002 Jones et al.
6,714,894 B1 3/2004 Tobey et al.
(Continued)

FOREIGN PATENT DOCUMENTS

CN 102467530 5/2012
WO WO 2011/101713 8/2011

OTHER PUBLICATIONS

International Search Report and Written Opinion for International Application No. PCT/US2013/046377, mailed Dec. 5, 2013, in 14 pages.

*Primary Examiner* — Mary Cheung
*Assistant Examiner* — Frederick Brushaber
(74) *Attorney, Agent, or Firm* — Knobbe, Martens, Olson & Bear LLP

(57) ABSTRACT

In one embodiment, a system for presenting fleet vehicle operation information in standardized forms includes a telematics module and a data standardizing module. The telematics module receives measurements related to operation of multiple vehicles in a fleet. The data standardizing module, using a first technique, estimates a first value for a parameter for at least one vehicle of the multiple vehicles based at least on the measurements. Further, the data standardizing module, using a second technique, estimates a second value for the parameter for at least one vehicle of the multiple vehicles based at least on the measurements. The second technique including using some measurement to estimate the second value different from the measurements used to estimate the first value according to the first technique. The data standardizing module outputs one or both of the first value and the second value for presentation to a user.

20 Claims, 5 Drawing Sheets

(51) Int. Cl.

| | |
|---|---|
| ***G07C 5/00*** | (2006.01) |
| *G07C 9/00* | (2006.01) |

(56) References Cited

U.S. PATENT DOCUMENTS

| | | | | |
|---|---|---|---|---|
| 7,103,460 | B1 * | 9/2006 | Breed | 701/32.9 |
| 7,221,270 | B2 * | 5/2007 | Chen et al. | 340/539.13 |
| 7,420,467 | B2 * | 9/2008 | Patenaude et al. | 340/572.1 |
| 7,430,470 | B2 * | 9/2008 | Cahoon | 701/115 |
| 7,627,406 | B2 * | 12/2009 | Wang et al. | 701/32.7 |
| 7,714,705 | B2 * | 5/2010 | Rennie et al. | 340/426.16 |
| 7,818,098 | B2 * | 10/2010 | Koepf et al. | 701/1 |
| 7,865,303 | B2 * | 1/2011 | Weiss et al. | 701/413 |
| 7,973,707 | B2 * | 7/2011 | Verechtchiagine | 342/357.33 |
| 8,077,098 | B2 * | 12/2011 | Snow et al. | 343/703 |
| 8,223,009 | B2 * | 7/2012 | Anderson et al. | 340/539.1 |
| 2005/0065678 | A1 | 3/2005 | Smith et al. | |
| 2005/0171660 | A1 | 8/2005 | Woolford et al. | |
| 2005/0203683 | A1 * | 9/2005 | Olsen et al. | 701/35 |
| 2006/0111868 | A1 * | 5/2006 | Beshears et al. | 702/173 |
| 2006/0212194 | A1 * | 9/2006 | Breed | 701/29 |
| 2007/0271014 | A1 * | 11/2007 | Breed | 701/29 |
| 2008/0147265 | A1 * | 6/2008 | Breed | 701/30 |
| 2008/0161989 | A1 * | 7/2008 | Breed | 701/29 |
| 2008/0269971 | A1 * | 10/2008 | Fernandez | 701/22 |
| 2010/0262325 | A1 * | 10/2010 | Fernandez | 701/22 |
| 2011/0071963 | A1 | 3/2011 | Piovesan et al. | |
| 2011/0106373 | A1 * | 5/2011 | Hergesheimer et al. | 701/33 |
| 2011/0238457 | A1 | 9/2011 | Mason et al. | |
| 2012/0245791 | A1 | 9/2012 | Yun et al. | |
| 2013/0024060 | A1 | 1/2013 | Sukkari et al. | |

* cited by examiner

SYSTEM FOR PROCESSING FLEET VEHICLE OPERATION INFORMATION

RELATED APPLICATIONS

This application claims the benefit of priority under 35 U.S.C. §119(e) to U.S. Provisional Patent Application No. 61/661,753, filed on Jun. 19, 2012, entitled "SYSTEM FOR PROCESSING VEHICLE DIAGNOSTICS INFORMATION," the disclosure of which is hereby incorporated by reference in its entirety.

BACKGROUND

A vehicle management system can be used to assist in operating and planning routes for a fleet of vehicles, including vehicles of different types, such as light-duty or heavy-duty vehicles, as well as vehicles of different makes, models, or model years. The vehicles in the vehicle fleet can be used to perform a variety of tasks that may depend in part on the types of vehicles or makes, models, or model years of the vehicles. A user of the vehicle management system can monitor routes for the vehicle fleet and access information about operation of the vehicle fleet via a user interface of the vehicle management system.

SUMMARY

For purposes of summarizing the disclosure, certain aspects, advantages and novel features have been described herein. It is to be understood that not necessarily all such advantages can be achieved in accordance with any particular embodiment disclosed herein. Thus, the features disclosed herein can be embodied or carried out in a manner that achieves or optimizes one advantage or group of advantages as taught herein without necessarily achieving other advantages as can be taught or suggested herein.

In accordance with some embodiments, a system for presenting fleet vehicle operation information in standardized forms includes a computer system including computer hardware programmed to implement a telematics module and a data standardizing module. The telematics module can be configured to receive measurements related to operation of a plurality of vehicles in a fleet of vehicles. The data standardizing module can be configured to, using a first technique, estimate a first value for a parameter for at least one vehicle of the plurality of vehicles based at least on one or more of the measurements. The parameter can be indicative of diagnostic information. The data standardizing module can further be configured to, using a second technique, estimate a second value for the parameter for at least one vehicle of the plurality of vehicles based at least on one or more of the measurements. The second technique can include using at least some measurement to estimate the second value that is different from the one or more of the measurements used to estimate the first value according to the first technique. The data standardizing can be further configured to output one or both of the first value and the second value for presentation to a user.

The system of the preceding paragraph can include a combination of one or more of the following features: The data standardizing module can be configured to estimate the first value for a first vehicle of the plurality of vehicles, and estimate the second value for the first vehicle. The data standardizing module can be configured to assign timestamps to the first value and the second value according to a time when the parameter is estimated. The data standardizing module can be configured assign a first quality value to the first value and a second quality value to the second value based at least on the measurements used to estimate the parameter. The data standardizing module can be configured to output one of the first value and the second value for presentation to the user based at least on whether the first value or the second value has a higher assigned quality value. The data standardizing module can be configured assign the first quality value and the second quality value further based on quality metrics associated with the measurements used to estimate the parameter. The telematics module can be configured to receive the measurements from in-vehicles devices associated with the plurality of vehicles. The measurements can include vehicle diagnostic data and global positioning system (GPS) data. The data standardizing module can be configured to estimate the first value further based on one or more previously estimated values for the parameter. The data standardizing module can be configured to store to a memory the first value and the second value, the measurements used to estimate the first value and the second value, and a link between the first value and the second value and the measurements used to estimate the first value and the second value.

In accordance with some embodiments, a method for presenting fleet vehicle operation information in standardized forms, the method including: accessing measurements related to operation of a plurality of vehicles in a fleet of vehicles; using a first technique, estimating a first value for a parameter for at least one vehicle of the plurality of vehicles based at least on one or more of the measurements, the parameter indicative of diagnostic information; using a second technique, estimating a second value for the parameter for at least one vehicle of the plurality of vehicles based at least on one or more of the measurements, the second technique comprising using at least some measurement to estimate the second value that is different from the one or more of the measurements used to estimate the first value according to the first technique; and outputting one or both of the first value and the second value for presentation to a user, wherein the method is performed by a computer system comprising computer hardware.

The method of the preceding paragraph can include a combination of one or more of the following features: The estimating the first value can include estimating the first value for a first vehicle of the plurality of vehicles, and wherein the estimating the second value can include estimating the second value for a second vehicle of the plurality of vehicles, the first vehicle being a different vehicle from the second vehicle. The outputting comprises outputting the first value and the second value for presentation to the user at the same time. The method can further include selecting the measurements used for estimating the first value and the second value based at least on a vehicle type of the first vehicle and a vehicle type of the second vehicle. The selecting can include selecting the measurements further based on devices used to determine the measurements, an amount of data used to store the measurements, and an accuracy of the first value and the second value. The method can further include generating a first configuration message for a first in-vehicle device associated with the first vehicle and a second configuration message for a second in-vehicle device associated with the second vehicle, the first configuration message instructing to determine the selected one or more of the measurements for the first vehicle, the second configuration message instructing to determine the selected one or more of the measurements for the second vehicle. The selecting can include selecting the measurements for the first vehicle and the second vehicle using a dependency tree, the dependency tree organizing and ranking at least some of the measurements usable to estimate the parameter.

In accordance with some embodiments, non-transitory physical computer storage including instructions stored thereon for implementing, in one or more processors, a method for presenting fleet vehicle operation information in standardized forms, the method including: accessing measurements related to operation of a plurality of vehicles in a fleet of vehicles; using a first technique, estimating a first value for a parameter for at least one vehicle of the plurality of vehicles based at least on one or more of the measurements, the parameter indicative of diagnostic information; using a second technique, estimating a second value for the parameter for at least one vehicle of the plurality of vehicles based at least on one or more of the measurements, the second technique comprising using at least some measurement to estimate the second value that is different from the one or more of the measurements used to estimate the first value according to the first technique; and outputting one or both of the first value and the second value for presentation to a user.

The non-transitory physical computer storage of the preceding paragraph can include a combination of one or more of the following features: The estimating the first value can include estimating the first value for a first vehicle of the plurality of vehicles, and wherein the estimating the second value can include estimating the second value for the first vehicle. The estimating the first value can include estimating the first value for at least one hundred vehicles of the plurality of vehicles and estimating the first value for a first vehicle of the plurality of vehicles, and wherein the estimating the second value can include estimating the second value for at least one hundred vehicles of the plurality of vehicles and estimating the second value for a second vehicle of the plurality of vehicles, the first vehicle being a different vehicle from the second vehicle.

BRIEF DESCRIPTION OF THE DRAWINGS

The features of various embodiments disclosed herein are described below with reference to the drawings. Throughout the drawings, reference numbers are re-used to indicate correspondence between referenced elements. The drawings are provided to illustrate embodiments described herein and not to limit the scope thereof.

DETAILED DESCRIPTION

I. Introduction

Figure 1:
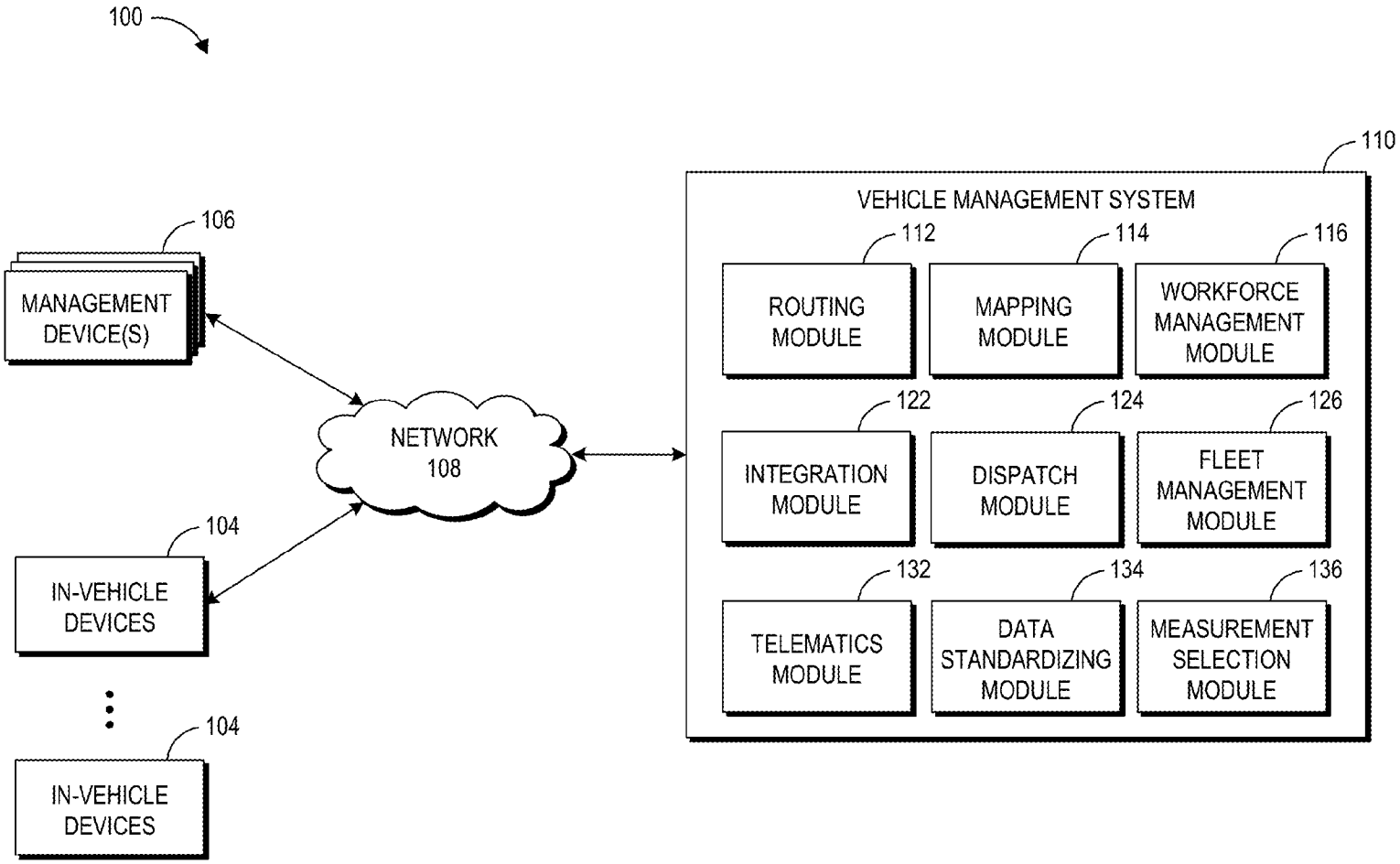
FIG. 1 illustrates an embodiment of a vehicle management system.

A user of a vehicle management system may have a set of vehicle operation information, such as diagnostic and status information, that the user wants to monitor for a fleet of vehicles or assets. For example, the user may want to monitor fuel economy for a fleet of vehicles. However, the user's vehicle fleet may include vehicles having different makes, models, or model years having different operation reporting capabilities. As a result, the data available to the vehicle management system may be different for some of the vehicles than other vehicles of the fleet. Because of the variation in data available to the vehicle management system, providing standardized operation information to the user can be problematic.

Accordingly, in some embodiments of the present disclosure, a vehicle management system can standardize disparate measurements into a uniform set of information related to a vehicle fleet for storage or presentation to a user of the vehicle management system. The vehicle management system can estimate the same information, such as diagnostic or status information, one or more times for one or more vehicles using one or more different measurements. This standardized information can enable the user of the vehicle management system to receive meaningful vehicle operation information in a uniform form while relieving the user of the burden of considering one or more sources of the measurements to determine the information. The standardized measurements can moreover be readily compared to other measurements for the vehicle or across diverse vehicle types, makes, models, or years, or the like.

In addition, in some vehicle management systems, if a user wants to track vehicle operation data, the user manually selects vehicle measurements to track in order to determine desired information indicative of operation of one or more fleet vehicles. This approach however has resulted in several problems. The user may misconfigure the vehicle measurements so that the desired measurements are not correctly monitored. These types of errors unfortunately can be difficult to detect. Additionally, manual configuration of measurements is both time-consuming and cumbersome for the user and may not result in an efficient usage of resources for determining the desired information.

Accordingly, in some embodiments of the present disclosure, a vehicle management system can select a reduced or minimum set of available measurements to use in determining a uniform set of monitored information, such as diagnostic or status information, for a vehicle fleet. The vehicle management system can automatically select a set of measurements based on one or more criteria, such as the measurements necessary to generate the uniform set of information, the vehicle type of vehicles in the vehicle fleet, the in-vehicle devices associated with the vehicles, an amount of data used to store the measurements, an accuracy of the information estimated, or the like.

Moreover, vehicle management systems face several data storage problems when it comes to storage of data. For example, if only raw measurement data (e.g., measurement that that has not been processed or normalized) is stored by a vehicle management system, then the various components of the vehicle management system may not be able to process the raw measurement data unless the components have the capability to decode the raw measurement data correctly. Raw measurement data in this format further may not be suitable for presentation, analysis, or use in creating certain historical reports. On the other hand, the raw measurement data can be processed to standardize or normalize the data into a format that the various components of the vehicle management system can decode and process, and this standardized measurement data can be stored. However, standardization may create transformation and configuration problems. For instance, unlike raw measurement data, standardized measurement data may not be capable of being interpreted in different ways. Also, useful analysis that depends on how the raw data was measured and processed may be sacrificed due to the transformation. If there was an error in the standardized measurement data, for example, it would be difficult to determine what a measurement should have been.

Accordingly, in some embodiments of the present disclosure, a vehicle management system saves disparate measurements and corresponding standardized information to a single database, along with links between the measurements and standardized information. The links can include one or more indications of the approaches or techniques used to standardize the disparate measurements and pointers associating the measurements and standardized information.

II. Vehicle Management System Overview

FIG. 1 illustrates an embodiment of a computing environment 100 for processing standardized vehicle operation information using a vehicle management system 110. Among other features, the example vehicle management system 110 shown includes a telematics module 132, a data standardizing module 134, and a measurement selection module 136 that can receive and analyze vehicle data to provide vehicle operation information and configure the collection of measurement data related to the operation of fleet vehicles. Prior to describing the functionality of these modules in detail, the computing environment 100 and other aspects of the vehicle management system 110 will be described.

In the computing environment 100, one or more in-vehicle devices 104 and management devices 106 communicate with the vehicle management system 110 over a network 108. The in-vehicle devices 104 can include computing devices installed in fleet vehicles. These devices 104 can include navigation functionality, routing functionality, and the like. The in-vehicle devices 104 can receive route information and other information from the vehicle management system 110. In addition, the in-vehicle devices 104 can report information to the vehicle management system 110, such as driver location, vehicle sensor data, vehicle status (e.g., maintenance, tire pressure, or the like), and so forth.

The illustrated network 108 may be a LAN, a WAN, the Internet, combinations of the same, or the like. For ease of illustration, the vehicle management system 110 has been depicted as a centralized system or platform. However, in other implementations, at least some of the functionality of the vehicle management system 110 is implemented in other devices or in multiple servers or data centers. For example, the vehicle management system 110 can be implemented as software as a service (SaaS) in the cloud and may be located in multiple data centers around the world (or portion thereof). Other possible implementations of the vehicle management system 110 can include many more or fewer components than those shown in FIG. 1.

The management devices 106 can be computing and input/output (I/O) devices used by dispatchers, fleet managers, administrators, or other users to manage different aspects of the vehicle management system 110. For example, a user of a management device 106 can access the vehicle management system 110 to generate routes, dispatch vehicles and drivers, and perform other individual vehicle or fleet management functions. With the management devices 106, users can access and monitor vehicle information obtained from one or more of the in-vehicle devices 104 by the vehicle management system 110. Such vehicle status information can include data on vehicle routes used, stops, speed, vehicle feature usage (such as power takeoff device usage), driver behavior and performance, vehicle emissions, vehicle maintenance, energy usage, and the like. In some embodiments, the management devices 106 are in fixed locations, such as at a dispatch center. The management devices 106 can also be used by administrators in the field, and may include mobile devices, laptops, tablets, smartphones, personal digital assistants (PDAs), desktops, or the like.

The vehicle management system 110 can be implemented by one or more physical computing devices, such as servers. These servers can be physically co-located or can be geographically separate, for example, in different data centers. In one embodiment, the vehicle management system 110 is implemented as a cloud computing application. For instance, the vehicle management system 110 can be a cloud-implemented platform hosted in one or more virtual servers and/or physical servers accessible to users over the Internet or other network 108. In the depicted embodiment, the vehicle management system 110 includes a fleet management module 126, a mapping module 114, a telematics module 132, a routing module 112, a dispatch module 124, an integration module 122, a data standardizing module 134, and a measurement selection module 136. These components can, but need not, be integrated together on a common software or hardware platform.

The fleet management module 126 can include functionality for generating, rendering, or otherwise displaying one or more vehicle management user interfaces. The vehicle management user interfaces can include a map or list of vehicles that depicts symbols or other data representative of vehicles. In addition, the vehicle management user interfaces can optionally include a history timeline display. For example, in response to user selection of one or more of the vehicle symbols from the map or list, the vehicle management user interface can output one or more vehicle history timelines corresponding to the selected vehicle or vehicles. Although the fleet management module 126 generates the user interface, in certain embodiments the fleet management module 126 outputs the user interface to the management devices 106, which actually display the user interface and associated history timeline display. Thus, as used herein, the terms "output a user interface for presentation to a user," "presenting a user interface to a user," and the like, in addition to having their ordinary meaning, can also mean (among other things) transmitting user interface information over a network, such that a user device can actually display the user interface.

The fleet management module 126 can communicate with the mapping module 114 to obtain mapping data, which the fleet management module 126 can include in the vehicle management user interface. The mapping data can be compressed, transmitted, re-rendered, and displayed on the management user interface. Other data can also be overlaid to enhance the map and management layout. The mapping module 114 can be a geographic information system (GIS) in one embodiment. The fleet management module 126 can also access the telematics module 132 to obtain vehicle status data for inclusion in vehicle history displays. The telematics module 132 can provide this vehicle status data based on telematics data obtained from the in-vehicle devices 104. The telematics data can include data such as location or speed information obtained using sequential GPS or cellular tower triangulation (or other methods), vehicle sensor data, solid state inertial information, or any other data that can be obtained from a vehicle, its engine, or the like (including other sensors such as passenger seat sensors to detect the presence of passengers and so forth).

The routing module 112 can construct pre-dispatch or post-dispatch routes for vehicles based on any of a variety of routing algorithms, such as those disclosed in U.S. Publication No. 2010/0153005, filed Dec. 8, 2009, and entitled "System and Method for Efficient Routing on a Network in the Presence of Multiple-Edge Restrictions and Other Constraints," the disclosure of which is hereby incorporated by reference in its entirety. In addition, the routing module 112 can automatically select routes that take into account factors that affect energy usage using the techniques described in U.S. application Ser. No. 12/954,547, filed Nov. 24, 2010, and entitled "Vehicle Route Selection Based on Energy Usage," the disclosure of which is hereby incorporated by reference in its entirety.

The integration module 122 can facilitate integration of the vehicle management system 110 with other systems, such as fuel card systems, payroll systems, supply chain system, insurance systems, and the like. The dispatch module 124 can provide functionality for users of the management devices 106 to assign drivers and vehicles to routes selected by the routing module 110.

In the depicted embodiment, the vehicle management system 110 includes a telematics module 132, a data standardizing module 134, and a measurement selection module 136. Each of these modules can be implemented in hardware and/or software.

III. Telematics Module

The telematics module 132 can obtain and receive measurement data related to vehicles and fleets of vehicles via telematics data received from the in-vehicle devices 104. The telematics data can include data such as location or speed information obtained using GPS or cellular tower triangulation (or other methods), vehicle sensor or diagnostic data, solid-state inertial information, or any other data that can be obtained from a vehicle, its engine, or the like (including other sensors such as passenger seat sensors to detect the presence of passengers and so forth). Examples of specific measurements that can be obtained for some fleet vehicles include A/C System Refrigerant Monitor, Alternator Voltage, Brake Indicator Light, Coasting Time, Engine Oil Level, Fuel Level, Hydraulics On, Odometer, Rear Door, Tire 3 Pressure, Total Fuel Used, and Turn Signal Status. Other examples of specific measurements are described below with respect to FIG. 2. In some implementations, telematics data can be additionally or alternatively received from one or more other sources, for example, such as directly from other components of the vehicle, via manual data entry to a user interface (e.g., by the driver), or a server configured to receive and store fleet vehicle operation measurements.

Since a vehicle fleet may include vehicles having different makes, models, and or model years having different operation reporting capabilities (e.g., providing direct measurements or one or more indirect measurements of vehicle operations information), the data available to the telematics module 132 can be different for some vehicles of the vehicle fleet than for other vehicles. In one example, if a vehicle fleet includes both light-duty vehicles, such as commuter vehicles, and heavy-duty vehicles, such as semi-trailers, the light-duty and heavy-duty vehicles can report different operation measurements usable for understanding the operation of the vehicles. The heavy-duty vehicles and one group of the light-duty vehicles can, for instance, maintain an odometer measurement readable by the in-vehicle devices 104. The odometer measurement can be provided by the in-vehicle devices 104 to the telematics module 132. On the other hand, another group of light-duty vehicles in the vehicle fleet may not be capable of outputting odometer measurements readable by the in-vehicle devices 104. Instead, the drivers of the vehicle may be expected to manually read the odometer measurements and provide the measurements with corresponding timestamps for input to the telematics module 132.

In another example, a vehicle fleet includes different makes and model years of trucks having different fuel measurement reporting capabilities. One group of makes and years of trucks in the fleet can provide measurements of lifetime usage of fuel that are readable by the in-vehicle devices 104. On the other hand, another group having different makes and years of trucks can provide running measurements of fuel used per time that are readable by the in-vehicle devices 104. The different fuel measurements from the groups can be provided to the telematics module 132 so that uniform fleet vehicle fuel consumption information can be determined for the trucks and provided to a user of the vehicle management system 110.

The meaning of measurements related to vehicles in a fleet may further depend on the make, model, type, and year of the vehicles. For example, measurements available from a motorcycle may have a different meaning from the measurements available from a car, truck, crane, fork lift, or another vehicle. As one example, a fuel low indication from a car may correspond to a certain percentage of remaining fuel in the fuel tank (e.g., 20% fuel remaining) that differs from the fuel low indication from a truck which corresponds to a higher percentage of fuel remaining in the fuel tank (e.g., 25% fuel remaining).

The type and capabilities of the in-vehicle devices 104 can also influence the available measurements from vehicles that are provided to the telematics module 132. In one example, some in-vehicle devices 104 are capable of communicating with an engine computer to obtain a measurement of engine revolutions per minute (RPM) for a vehicle. Other in-vehicle devices 104 may not be capable of communicating with the engine computer and thus may rely on one or more other measurements usable to determine the RPM measurement for the vehicle. In another example, some in-vehicle devices 104 are equipped with GPS features that enable the in-vehicle devices 104 to calculate a distance traveled by the vehicles. The calculation can provide measurements comparable to the odometer readings of the vehicles. In yet another example, some in-vehicle devices 104 are capable of determining fuel economy for vehicles by directly obtaining measurements of fuel economy provided by the vehicles. On the other hand, other in-vehicle devices 104 are capable of using measurements of an amount of fuel consumed and distance traveled to calculate fuel economy for the vehicles.

Because the accuracy or precision of measurements can vary significantly depending on the source, timing, sophistication, or the like for the measurements, the measurements obtained by the telematics module 132 can be associated with one or more indications of the quality of the measurements. In some embodiments, the telematics module 132 can assign a value from a range of values that corresponds to the level of quality for one or more measurements. This assignment can be based on the source of information, age of information, precision of information, estimated accuracy of information, or the like. Additionally or alternatively, the telematics module 132 can receive the measurements and one or more indications of the quality of the measurements from the in-vehicle devices 104. Moreover, in some embodiments, the one or more indications of the quality of the measurements can be utilized by the telematics module 132 to manage or process the measurements. For instance, the telematics module 132 can request or discard certain measurements related to particular vehicles in the vehicle fleet based on the one or more indications of the quality.

IV. Data Standardizing Module

The data standardizing module 134 can standardize disparate measurements obtained by the telematics module 132 into a uniform set of information related to a vehicle fleet for storage or presentation to a user of the vehicle management system 110. For instance, the data standardizing module 134 can estimate the same information, such as diagnostic or status information, one or more times for one or more vehicles using one or more different measurements. The standardized information can enable the user of the vehicle management system 110 to receive meaningful vehicle operation information in a uniform form while relieving the user of the burden of considering one or more sources of the measurements used to determine the information. The standardized measurements can be readily compared to other measurements for the vehicle or across diverse vehicle types, makes, models, or years, or the like.

The data standardizing module 134 can estimate the same information for multiple vehicles using at least some different measurements from the multiple vehicles. For example, the data standardizing module 134 can determine the odometers readings (e.g., indicative of a distance traveled by the vehicles) for one group of vehicles in a vehicle fleet based on odometer measurements provided by the computer engines of the vehicles to associated in-vehicle devices 104. At the same time or substantially the same time, the data standardizing module 134 can determine a distance traveled by a different group of vehicles in the vehicle fleet based at least on GPS measurements from associated in-vehicle devices 104 (e.g., by determining a straight-line distance traveled by the vehicles every few seconds). The odometer reading and GPS measurements can compared together to determine information about the distance traveled by the vehicles of both groups over a certain time.

The data standardizing module 134 can estimate the same information about a vehicle in a vehicle fleet multiple times utilizing at least some different measurements from the vehicle. For example, a vehicle's engine computer may provide an odometer measurement to an associated in-vehicle device 104 once every hour (or some other time period in other cases). The in-vehicle device 104 can also be equipped with GPS functionality usable to determine an indication of the distance traveled by the vehicle. As a result, the data standardizing module 134 can rely on both or either of the hourly odometer measurements or calculations using the GPS position to determine a distance traveled by the vehicle over a certain time. The data standardizing module 134 can switch between two or more sources as available measurements change or select between or weight the two or more measurements based on indications of the quality of the measurements to determine the estimates of the same information.

The data standardizing module 134 can group vehicles having one or more similar or same available measurements to assist in the standardization of disparate measurements for vehicles. The one or more groups associated with the vehicles can thus indicate the measurements available from the vehicle for determining standardized information. The data standardizing module 134 can advantageously, in certain embodiments, standardize measurements from the vehicles using one or more rule sets corresponding to the one or more groups associated with the vehicles. For example, the data standardizing module 134 can standardize measurements from 2006 model-year Brand A trucks in a vehicle fleet using the same determinations based on the same measurements (e.g., determine total mileage for the vehicles using the GPS position of the vehicles rather than odometer readings from engine computers), and the 2006 model-year Brand A trucks can be assigned the same groups and rule sets for processing the measurements. In another example, Brand A vehicles can be assigned to one group having some measurements in common (e.g., determine total mileage for the vehicles using the GPS position of the vehicles); however, Brand A trucks and Brand A cars can be assigned to one or more different groups as having one or more different measurements from one another (e.g., determine total engine-on hours for Brand A trucks using the measurements from engine computers while determine total engine-on hours for Brand A cars based on the duration that binary status indications indicate that the engines are turned on).

Timestamps can be assigned to one or more determined estimates of information by the data standardizing module 134. The timestamps can be used to track recency of the determinations, as well as in determining or assigning quality indications to the determinations. In some cases, for example, a recently determined estimate can correspond to a higher quality estimate than a less recently determined estimate.

The data standardizing module 134 can further determine one or more indications of the quality of determined estimates of information. The indications of quality of an estimate can be based at least on a quality of the measurements used to estimate the information, a recency of the measurements used to determine the estimate, a recency of the estimate, an availability of other measurements or estimates, an accuracy or precision of the estimate or measurements used to determine the estimate, a frequency of use of the measurements or estimate, or the like. For example, the data standardizing module 134 can calculate the total number of miles that a vehicle has traveled using GPS position measurements gathered by an in-vehicle device 104 associated with the vehicle. However, the calculations using this approach may include significant errors due to accumulated errors of GPS data. Accordingly, in some cases, short-term distance determinations based on GPS position measurements can be assigned a higher quality than longer-term distance determinations based on GPS position measurements. Moreover, the distance determinations based on the GPS position measurements can be assigned a lower quality than distance determinations based on the odometer readings from a vehicle's engine computer. Further, the odometer reading provided by a driver of the vehicle can be used to update distance determinations based on GPS position measurements or revise assigned quality indications if the distance determinations prove more or less accurate than the relatively accurate driver-provided odometer readings.

Numerous examples of ways that the data standardizing module 134 can standardize disparate measurements are next described in detail. The following examples are provided as non-limiting examples to illustrate applications of the data standardizing module 134 in determining estimates of the same information one or more times for one or more vehicles using one or more different measurements.

In one example, a user may desire to determine if disparate vehicles in a fleet of vehicles are speeding. The data standardizing module 134 can accordingly access data usable to determine whether the vehicles are speeding. For instance, vehicle measurements such as vehicle speed and positions at certain times can be received from the telematics module 132. In addition, the routing module 112 or mapping module 114 can provide speed limit data at relevant locations and times for the vehicles. Based on the data, the data standardizing module 134 can determine whether the vehicles have been speeding, when the speeding occurred, how long speeding occurred for, how often the vehicles are speeding, and by how much the vehicles were driven over the speed limit. One or more pieces of this information can be displayed as standardized speeding diagnostics for a user of the vehicle management system 110.

In another example, a user can desire to determine the total number of hours that engines of vehicles of a fleet of vehicles are turned on. The engine computers of some vehicles of the fleet may directly measure the total number of hours the engines are on, and these measurements can be obtained by the data standardizing module 134. However, for other vehicles of the fleet, the only indication of engine on-time is a binary status of whether the engines are turned on or off. The data standardizing module 134 can, for these vehicles, calculate the total engine-on hours based on the duration that the binary status indicates the engines are turned on. The data standardizing module 134 thus can determine the total number of engine-on hours for the fleet of vehicles as standardized diagnostic despite the fact that some vehicles do not directly provide the measured total number of engine-on hours.

In an additional example, a user may desire to determine the hydraulic status of vehicles in a fleet of vehicles. Some vehicles in the fleet of vehicles can directly measure the hydraulic status of the vehicles and provide the measurement to in-vehicle devices 104. Other vehicles in the fleet of vehicles, however, can provide the hydraulic status based on a calculation using the hydraulic pressure level. When the hydraulic pressures are greater than zero, the data standardizing module 134 can determine that the hydraulics are on. The data standardizing module 134 thus can determine the hydraulic status for the vehicles in a fleet of vehicles as a standardized diagnostic despite the fact that some vehicles do not directly provide the hydraulic status for the vehicles. An example of pseud-code that can be used to implement this determination, as well as a further determination of an Idling standardized diagnostic, is as follows.

```
//Example rule showing that if don't have hydraulics
//status, it can be derived from hydraulics pressure.
IF (missing(Hydraulics On)):
  IF (Hydraulic Pressure>0):
    Publish Hydraulics On=True
  ELSE:
    Publish Hydraulics On=False
//Use of the hydraulics can mean a vehicle
//is not idle (e.g., in a non-productive sense).
IF (Hydraulics On==True):
  Idling=False
//In an event stream, changes in the Idling status can be stored.
//The accumulated state of a vehicle can include the current
  Idling status.
Edges Only(Idling)
```

In a fourth example, a user can desire to monitor total vehicle mileage for vehicles in a fleet of vehicles. Some vehicles in the fleet vehicles can directly measure the total mileage using an odometer measurement and provide the measurement to in-vehicle devices 104. The total mileage can alternatively be determined by the data standardizing module 134 for other vehicles in the vehicle fleet using GPS features of in-vehicle devices 104 associated with the vehicles. Further, additional vehicles in the vehicle fleet can provide associated in-vehicle devices 104 a trip distance from one stop to a next stop. For the additional vehicles, the data standardizing module 134 can accumulate the trip distances relative to a manually-entered initial odometer reading. The data standardizing module 134 thus can determine the total vehicle mileage for the vehicles in a fleet of vehicles as standardized diagnostic despite the fact that some vehicles do not directly provide the total vehicle mileage to the in-vehicle devices 104.

In a fifth example, a user can desire to determine if vehicles in a fleet of vehicles have incurred a hard acceleration event. However, whether a hard acceleration event has occurred can depend in part on the type of vehicle, such as whether the vehicle is a truck, car, motorcycle, or some other vehicle. The data standardizing module 134 can access distance or position measurements from the telematics module 132 to determine accelerations for the vehicles, as well as access vehicle-type hard acceleration limits from the fleet management module 126. Based on the determined accelerations and corresponding vehicle-type hard acceleration limits, the data standardizing module 134 can determine if the vehicles in the fleet incurred hard acceleration events and present this information as a standardized diagnostic to a user of the vehicle management system 110.

In a sixth example, a user may desire to determine the RPMs of engines of vehicles in a fleet of vehicles. The RPM measurements, however, can be provided differently by different makes and models of trucks in the fleet, as well as different model years of trucks in the fleet. The data standardizing module 134 can access information from a memory in the vehicle management system 110 regarding how the different makes, models, and years report the measurements so that the data standardizing module 134 can standardize the estimated RPM information into a common form.

In some embodiments, the vehicle management system 110 can save disparate measurements and standardized information to a database, along with links between the measurements and the standardized information. The links can include one or more indications of the approaches or techniques used to standardize the disparate measurements and pointers associating the measurements and standardized information. Storing the link in an appropriate compact form can allow quick interactive access, traceable data pedigrees, and storage of long-term history. Although storing both the measurements and standardized information can result in redundantly storing some information, storing both the measurements and standardized information can enable faster processing and enhanced data interpretation by the vehicle management system 110. In some implementations, the standardized information can be discarded at some point, such as in the long-term, since the measurements and link alone can be used to reconstruct the standardized information.

V. Measurement Selection Module

The measurement selection module 136 can select a reduced or minimum set of available measurements to use in determining a uniform set of monitored information, such as diagnostic or status information, for a vehicle fleet. The measurement selection module 136 can utilize standardization approaches or techniques used by the data standardizing module 134 to initially build a list of potential sources for the uniform set of information. From the list of potential sources, the measurement selection module 136 can automatically select a set of measurements based on one or more of: the measurements necessary to generate the uniform set of information, the vehicle type of vehicles in the vehicle fleet, the in-vehicle devices 104 associated with the vehicles, an amount of data used to store the measurements, an accuracy of the information estimated by the data standardizing module 134, or the like. The remaining measurements that are not considered one of the potential sources may, in some cases, simply not be selected by the measurement selection module 136.

In some embodiments, the measurements having a higher assigned quality can be selected first by the measurement selection module 136 for determining information before one or more other measurements having a lower assigned quality. The measurements can be ranked by quality scores associated with the measurements or the sources for the measurements, and the measurement selection module 136 can select one or more of the measurements that are the highest ranked. Additionally or alternatively, categories of the uniform set of information can have one or more associated default measurements for determining information for the categories. The measurements not deemed to be default measurements for a category can be assigned a higher, equal, or lower quality score than the default measurements for the category depending on the quality of the measurements relative to the default measurements. In one example implementation, the odometer reading from a vehicle can, for instance, provide a higher quality measurement for a distance information than distance information calculated based on the GPS positions of the vehicle. Thus, the odometer reading can be selected first by the data standardizing module 134 if the odometer reading is available from one or more vehicles in a vehicle fleet before selecting a distance calculated based on the GPS positions.

In another example, a user of the vehicle management system 110 may desire to monitor fuel economy of vehicles in a vehicle fleet as part of a set of monitored information. If the fuel economy measurement can be taken directly by the vehicles, the measurement can be provided by the vehicles to the vehicle management system 110. On the other hand, if the fuel economy measurement may not be taken directly by the vehicle, one of multiple potential measurements can be selected to determine fuel economy. The selection of which one or more measurements to use can be made by comparing the measurements that are actually provided by the vehicles with one or more rankings of the multiple potential measurements usable to determine fuel economy. The one or more measurements which are both provided by a particular vehicle and have the highest ranking can be selected to determine the fuel economy for the particular vehicle.

The ranking of measurements can be arranged using one or more criteria. In some implementations, the ranking of measurements can depend at least on the amount of hardware or processing time used to calculate the desired information. As the amount of hardware or processing time increases for one or more measurements, the ranking of the one or more measurements decreases. In some implementations, the ranking of measurements can depend at least on an amount of data transferred between vehicles, in-vehicle devices 104, and the vehicle management system 110. The ranking of measurements thus can be arranged so that the amount of data transferred between certain components, such as the in-vehicle devices 104 and the vehicle management system 110, can be reduced or minimized. In some implementations, the ranking of measurements can depend at least on an accuracy of the measurements. One or more measurements having a greater accuracy can be ranked higher than one or more measurements having a lower accuracy.

Multiple types of data structures can be used to organize the ranking of measurements. The data structures used can, for instance, be any hierarchical data structure. In some embodiments, a dependency tree data structure is used to organize the ranking of potential measurements for a given piece of information. The dependency tree can have the direct measurement of the given piece of information as the root node. Each branch node or terminal node of the dependency tree can correspond to one indirect measurement for the given piece of information. The nodes which are closer to the root node can be considered to have a higher ranking and thus selected first for determining the given piece of information before other nodes farther from the root node. The dependency tree can facilitate a relatively fast selection of the measurements for determining the given piece of information since the nodes of the dependency tree can be traversed in order when searching for the measurements having the highest ranking.

The vehicle management system 110 can further alter the costs charged to a user of the vehicle management system 110 based on which measurements are used to determine a desired set of information. The billing rates for the user could vary, for instance, depending on the number of measurements monitored, types of measurements monitored, or amount or complexity of the calculations done using the measurements to obtain the desired information. In addition, the measurement selection module 136 can further select the set of measurements based on pricing considerations for the user of the vehicle management system 110. For example, the accuracy of measurements or processing power used to determine information based on the measurements can correspond to a cost charged for the user of the vehicle management system 110 to use the measurements. For measurements having greater accuracy or using greater processing power of the vehicle management system 110, the cost charged for using the measurements can be higher. Moreover, the user can override one or more selections by the measurement selection module 136 to adjust the billing for use of the vehicle management system 110. In some embodiments, the vehicle management system 110 can further alter the costs charged the user based at least on the amount of bandwidth used for communicating the measurements and other associated data between the in-vehicle devices 104 and vehicle management system 110. The amount of bandwidth used can correspond to the costs incurred by the operator of the vehicle management system 110 to service the in-vehicle devices 104 or management devices 106.

The measurement selection module 136 can generate configuration messages for processing by the in-vehicle devices 104. The configuration messages can provide instructions for the in-vehicle devices 104 or associated vehicles to determine or collect the measurements selected by the measurement selection module 136. In turn, in response to the configuration messages, the in-vehicle devices 104 or associated vehicles can enable the determination or collection of the selected measurements or transmission of the measurements to the vehicle management system 110. In some embodiments, in response to the configuration messages, the in-vehicle devices 104 or associated vehicles can further disable the determination, collection, or transmission of one or more measurements not selected by the measurement selection module 136.

VI. Custom Fleet Vehicle Data Storage and Presentation

The vehicle management system 110 can enable a user of the vehicle management 110 system to customize data monitoring. For example, the vehicle management system 110 can provide the user with real-time information about various standard fleet management variables for a vehicle or asset. In one embodiment, the vehicle management system normalizes a set of fleet management parameters. Some or all of the parameters in the normalized set of parameters can have a unique identifier to distinguish the parameters from the rest of the set. However, many users have their own data they want to monitor that is not part of the standard fleet management parameters provided by the vehicle management system 110.

Advantageously, in certain embodiments, the vehicle management system 110 may allow for new parameters to be added without normalizing the parameters as with the standard fleet management parameters. These custom parameters however may entail additional data processing during acquisition, interpretation, storage and presentation of the data. To address this issue, one approach includes normalizing the custom parameters so that they have an identifier but not all of the features of the standard fleet management parameters. This approach can reduce the amount of processing time and allow a user to customize their monitored data. Thus, a user can specify custom parameters for real time monitoring by the vehicle management system 110.

In one embodiment, an Application Programming Interface (API) is provided by the vehicle management system 110 to enable the user's custom parameters to be added to the vehicle management system 110. The user can send a message to the vehicle management system 110 via the API with some or all custom parameters the user wants the vehicle management system 110 to monitor and report. The vehicle management system 110 may not, in some cases, track additional hardware because the user is providing the real-time values of the custom parameters. While the custom parameters may have an associated identifier within the vehicle management system 110, the custom parameters may not obtain the additional features that the standard vehicle management system parameters have. However, in one embodiment, a user can further customize their custom parameters to include some or all of the features of the standard fleet management parameters. Furthermore, the vehicle management system 110 can bill the user based on which of the features are selected. Alternatively, the billing could be done à la carte in which a user pays a fee for the one or more features chosen by the user.

In one embodiment, a user sends the data to the vehicle management system 110 via a comma delimited file or via scripts. In one embodiment, each custom parameter is individually tied into the vehicle management system 110. In this case, the vehicle management system 110 can monitor the hardware associated with the custom parameter. In one embodiment, a monitored custom parameter includes a timestamp. In one embodiment, the monitored custom parameters can be stored and used for reporting purposes.

In one embodiment, the user can configure aspects of the monitored custom parameters, such as unpacking data values from acquisition messages, assessing the validity of the data, transforming data into forms suitable for storage, transforming data for presentation to a user, converting among unit systems and languages, and setting alarm conditions and thresholds.

A user of a vehicle tracking service may want to acquire data that is not directly related to normal fleet tracking and vehicle diagnostics data, to store that data with timestamps alongside tracking and diagnostics data, to display this information alongside other normal fleet tracking and vehicle diagnostic data, and to include such custom data in reports.

Moreover, one potential concern with storing custom data and presenting it is that each such customization can cause changes to data definitions (and sometimes code) in several places in the data processing chain (acquisition, interpretation, storage, and presentation) of the vehicle management system 110.

Accordingly, in some embodiments, the vehicle management system 110 can acquire, transport, store, and retrieve custom measurements and data alongside standard fleet management information without incorporating additional custom descriptions and translations into the standard fleet management products and data flow. A user can define aspects of the custom measurements and data in a way that lets the vehicle management system 110 acquire, store, and present it in ways that are meaningful to the user without the vehicle management system understanding or interpreting the data in one or more ways as would be done with standard vehicle management system data. The aspects can include but are not limited to: unpacking data values from acquisition messages, assessing validity of data, transforming data into forms suitable for storage, transforming data for presentation to a user, converting among unit systems and languages, and setting alarm conditions and thresholds.

VII. In-Vehicle Devices

Figure 2:
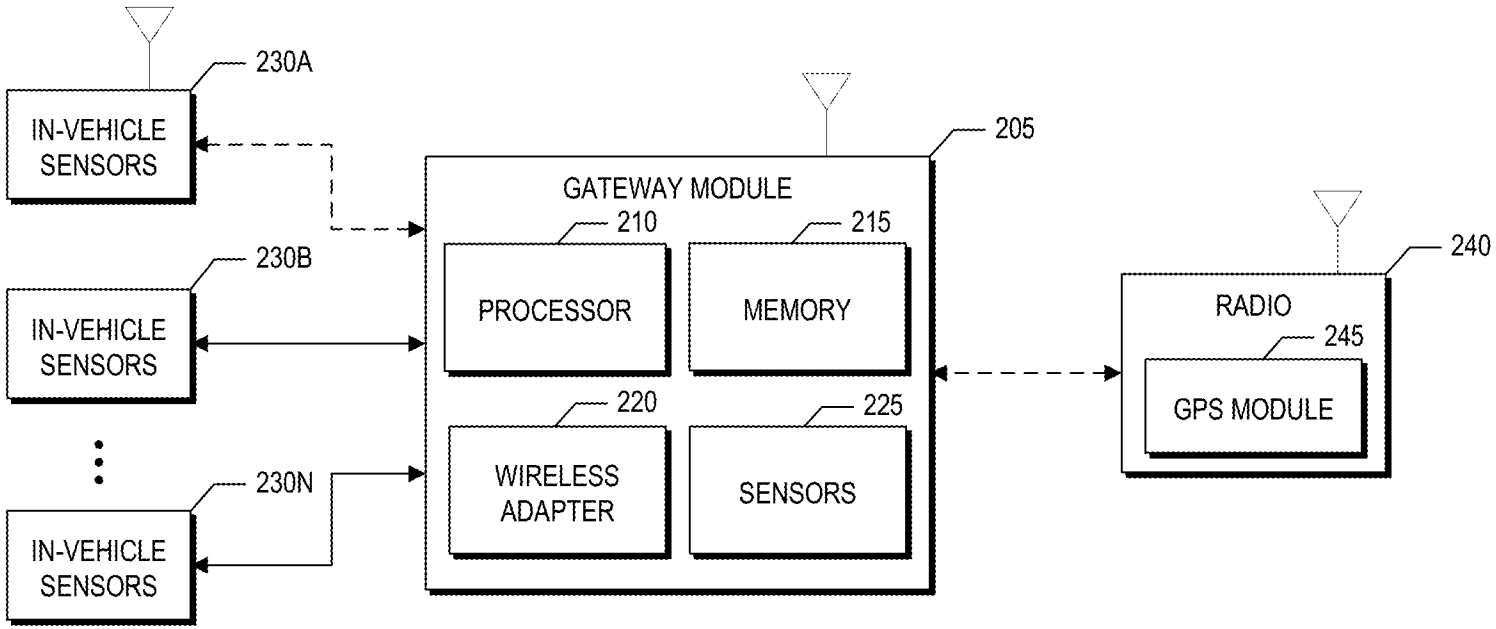
FIG. 2 illustrates an embodiment of an in-vehicle device.

FIG. 2 illustrates an embodiment of a gateway module 205. The gateway module 205 is a more detailed embodiment of an in-vehicle device 104 described above and includes all the features thereof. The gateway module 205 can be a vehicle based data acquisition and transmission sub-system. In the depicted embodiment, the gateway module 205 has a processor 210, memory 215, a wireless adapter 220, and one or more sensors 225. In some embodiments, the sensors 225 are omitted. The sensors 225 can be configured to measure vehicle data, such as vehicle position, temperature, time, acceleration, audio, and direction.

A radio 240 communicates with the gateway module 205, either wirelessly or through a wired connection (e.g., with a serial cable or the like). The radio 240 includes a GPS module 245 that detects vehicle position. The radio 240 can transmit data received from the gateway module 205 to the vehicle management system 110. The radio 240 can also communicate vehicle positioning data received from the GPS module 245 to the vehicle management system 110. In one embodiment, the radio 240 communicates with the vehicle management system by placing a cell phone call to a server of the vehicle management system 110. The radio 240 can also communicate with the server at the vehicle management system 110 by connecting to the network 108 using TCP/IP/UDP protocols. By sending data frequently or periodically, the radio 240 can maintain the connection to the server open, which can guarantee or help to guarantee data reliability.

Any number of in-vehicle sensors 230 located within the vehicle can communicate with the gateway module 205. The in-vehicle sensors 230 can be located throughout the vehicle, including, for example, the engine, tires, vehicle body, trailer, cargo areas, and other locations on and within the vehicle. Some examples of vehicle sensors include engine oil sensors, fuel level sensors, light sensors, door sensors, ignition sensors, temperature sensors (including in cab and in trailer), and tire pressure sensors. At least some of the in-vehicle sensors 230 can communicate with the engine computer or other engine hardware configured to receive and process the data. The in-vehicle sensors can also be located remotely and can transmit the data wirelessly to the engine computer or other data processing hardware. For example, a tire pressure sensor could wirelessly transmit tire pressure data to the engine computer for processing.

Likewise, the gateway module 205 can also include sensors. One example of a sensor 225 that may be included in the gateway is an accelerometer. An accelerometer can detect hard braking, cornering, and acceleration. The accelerometer can therefore allow position coordinates to be updated without resort to GPS or triangulation technology. For example, the accelerometer can provide for short-term position reporting that operates without resorting to GPS signals. The gateway module 205 can offer a low cost longitude, latitude capability and combined hard braking sensor for vehicle history applications, such as the vehicle history systems and methods described in U.S. application Ser. No. 13/251,129, titled "History Timeline Display for Vehicle Fleet Management," filed Sep. 30, 2011, the disclosure of which is hereby incorporated by reference in its entirety. As a device, in certain embodiments, the gateway module 205 can enable data from multiple sensors to be acquired without adding wires or optical connections.

The gateway module 205 can be in communication with some or all of the in-vehicle sensors 230. For example, the gateway module 205 can be coupled to an OBDII or CAN bus in the vehicle to thereby receive in-vehicle sensor information from the engine computer. In some embodiments, one or more in-vehicle sensors can be directly coupled to the gateway module 205, or the gateway module 205 can be configured to communicate wirelessly with the in-vehicle sensors. For example, the gateway module could receive cargo bay temperature data from a temperature sensor wirelessly transmitting the data. The wireless sensors can use point-to-point custom wireless transmission or using wireless transmission standards such as Bluetooth or Zigbee.

The processor 210 and memory 215 of the gateway module 205 can implement various features. The processor 210 of the gateway module 205 can control the functioning of the gateway module 205. The gateway module 205 can act as an intermediary processing platform for the vehicle management system 110. The gateway module 205 can process the data received from the in-vehicle sensors 230 and send a subset of the total data collected to the vehicle management system 110. The gateway module 205 can collect hundreds or thousands or more data points from sensors 225, in-vehicle sensors 230, and the engine computer. The gateway module 205 can, among other things, analyze, categorize, compress, or otherwise process the data before transmitting it to the vehicle management system 110. By preprocessing the data prior to sending the information to the vehicle management system 110, the gateway module 205 can determine what data to send to the vehicle management system 110, which can reduce redundant processing and bandwidth used to continually transmit vehicle data.

In some embodiments, the measurements determined by the sensors 225, in-vehicle sensors 230, or the engine computer can, for example, include one or more of the following: A/C System Refrigerant Monitor, ABS Active Lamp, Abnormal Refrigerator Temperature, Acceleration Violations, Accelerator Pedal Position, Air Inlet Temperature, Airbag Light, Alternator Current, Alternator Voltage, Amber Warning Lamp (DM1), Ambient Air Temperature, Ammonium Nitrate Grand Total, Antitheft System Active, Asset Power, Auto Lube Alarm, Average Fuel Economy, Backup Battery Voltage, Barometric Pressure, Battery Charge, Battery Voltage, Belly Dump, Boom Status, Brake Indicator Light, Brake Pedal Switch, Cab Interior Temperature, Cargo Air Temperature, Catalyst Monitor, Check Fuel Cap, Coasting, Coasting Time, Comprehensive Component Monitor, Coolant Hot Light, Coolant Level, Coolant Pressure, Cruise Control Set Speed, Cruise Control Status, Deceleration Violations, Defroster, Diagnostics Scan Tool Connected, Diesel Particulate Filter Status, Diesel Pump, Driver Door, Dump Arm, EGR System Monitor, Emulsion Grand Total, Emulsion Job Total, Engine Coolant Pressure, Engine Coolant Temperature, Engine Load, Engine Oil Level, Engine Oil Pressure, Engine Oil Temperature, Engine Speed, Engine Start Event, Engine Stop Event, Evaporative System Monitor, Failure Mode Identifier (DM1), Flash Amber Warning Lamp (DM1), Flash Malfunction Indicator Lamp (DM1), Flash Protect Lamp (DM1), Flash Red Stop Lamp (DM1), Fuel Level, Fuel Oil Grand Total, Fuel Oil Job Total, Fuel Rate, Fuel Remaining, Fuel System Monitor, Fuel Temperature, Gasoline Pump, Harsh Acceleration, Harsh Braking, Heated Catalyst Monitor, High Engine Temperature, High Wind Speed, Hopper #1-4, Hydraulic Fluid Temperature, Hydraulic Pressure, Hydraulics On, Idle Time, Ignition, In Cradle, J1939 DTC, Lift, Lights, Low Brake Fluid, Low Engine Oil Pressure, Low Fuel Level, Low Tire Pressure, Low Wind Speed, Malfunction Indicator Lamp Status (DM1), Max Acceleration, Max Deceleration, Misfire Monitor, Net Battery Current, OBDII DTC, Occurrence Count (DM1), Odometer, Oil Life Remaining, Oil Pressure Lamp, Oxygen Sensor Heater Monitor, Oxygen Sensor Monitor, PTO, Panic, Passenger Door, Pony Motor Running, Protect Lamp Status (DM1), RSSI, Raining, Rear Door, Red Stop Lamp Status (DM1), Refrigeration Temperature, Refrigeration Temperature 2, Reserved For Future Use, SPN Conversion Method (DM1), Seatbelt Fastened, Seatbelt Warning Light, Secondary Fuel Level, Service Trashcan, Side Door, Speeding Over Max, Suspect Parameter Number (DM1), Sweeper Engine, Tires 1-12 Pressure, Tires 1-12 Sensor ID, Tires 1-12 Temperature, Total Engine Time, Total Fuel Used, Total Idle Fuel Used, Total Idle Fuel Used, Total Idle Hours, Total PTO Time, Total Vehicle Time, Track Motor, Trailer Coupled, Transmission Fluid Temperature, Transmission Gear, Transmission Oil Level, Trip Distance, Trip Duration, Trip Fuel Used, Trip Fuel Used Idling, Trip Max Vehicle Speed, Trip Time At Full Throttle, Trip Time Driving Without Seatbelt, Trip Time In Optimal RPM Range, Trip Time Speeding, Trip Time With Cruise Control On, Trip Time With RPM High, Turn Signal Status, Vehicle Loaded, Vehicle Speed, Washer Fluid Level, Water In Fuel, Welder, iButton Driver Id Event.

The gateway module 205 can monitor several vehicle characteristics. The sensors 225, 230 can provide information to the gateway module 205 at a specific frequency for each vehicle characteristic; however, the sensors 225, 230 may generally be recording data at a faster rate than the monitored vehicle characteristic is changing. As such, sending all of the data to the vehicle management system 110 every time a sensor provides data can waste bandwidth and provide redundant data points for the vehicle management system 110 to process. Advantageously, in certain embodiments, instead of sending all of this data to the vehicle management system 110, the gateway module 205 processes the data and selectively updates the vehicle management system 110. The gateway module 205 can also compress the data that is received. The gateway module 205 can selectively compress portions of the data using wavelet transforms or other compression techniques, including any lossy or lossless compression techniques. For example, the data relating to vehicle characteristics that are slowly changing can be compressed.

The gateway module 205 can process vehicle characteristics according to the rate at which the characteristics change. For example, engine characteristics can range from relatively slower changing characteristics, such as tire pressure or average fuel consumption, to relatively faster changing characteristics, such as engine RPM and speed. The gateway module 205 can provide updates to the vehicle management system 110 using different update approaches for each vehicle characteristic, including periodic updates, threshold-based updates, event-based updates, user-specified updates, and/or a combination of methods.

Periodic updates can provide updates to the vehicle management system at a specified frequency. For example, the gateway module 205 may update the remaining vehicle fuel data every 5 minutes. Threshold based updates can provide updates when the value of the vehicle characteristic meets or exceeds a specified threshold. The thresholds can be static, determined dynamically by the system, user specified, or determined using any other method. The thresholds can be absolute, such as a specific value, or relative, such as a percentage based change a specific number of units. For example, tire pressure data could be updated when the tire pressure changes by 10%, or when it changes by 2 psi, or if pressure drops below 35 psi. Event-based updates can prompt updates after a specific event occurs. For example, an update of all the vehicle characteristics may be provided when the engine starts or when an engine error is detected.

The gateway module 205 can use a combination of methods or algorithms to determine the frequency of the updates to the vehicle management system 110. For example, the tire pressure data could have a periodic update and a threshold based update. The tire pressure data could be updated every 30 minutes. However if there was a blowout, it can be beneficial to have a more rapid or immediate update to the tire pressure. As such, the gateway module 205 could evaluate the tire pressure against a threshold that updates tire pressure when a change is detected. The gateway module 205 can provide update routines that are dependent on the operational phase of the vehicle, such as warm-up operation versus normal operation. As engine conditions stabilize after warm-up the gateway module 205 can increase the intervals at which updates are provided to the vehicle management system 110. In some embodiments the gateway module 205 can send the updated data to the vehicle management system 205 and the raw data. The raw vehicle data can include some or all of the data that the gateway module 205 receives from the sensors and vehicle computer. The raw data can be transmitted with or without the preprocessed updated vehicle data.

More generally, in certain embodiments, the gateway module 205 can be a system that performs wired or wireless data acquisition within a vehicle. The gateway module 205 can pool data from various sensors, apply time stamps to the data, reformat the data, encode the data, or encrypt the data. Software running on the gateway module 205 can manage data acquisition and data formatting. The gateway module 205 can therefore acquire diagnostic bus and motor vehicle status data and buffer the data and forward the data directly to the vehicle management system or another in-vehicle device (such as a driver's cell phone, tablet, or laptop) via WiFi, Ethernet, RS232/422, USB, or other suitable physical interfaces.

VIII. Example Vehicle Operation Data Standardization Process

Figure 3:
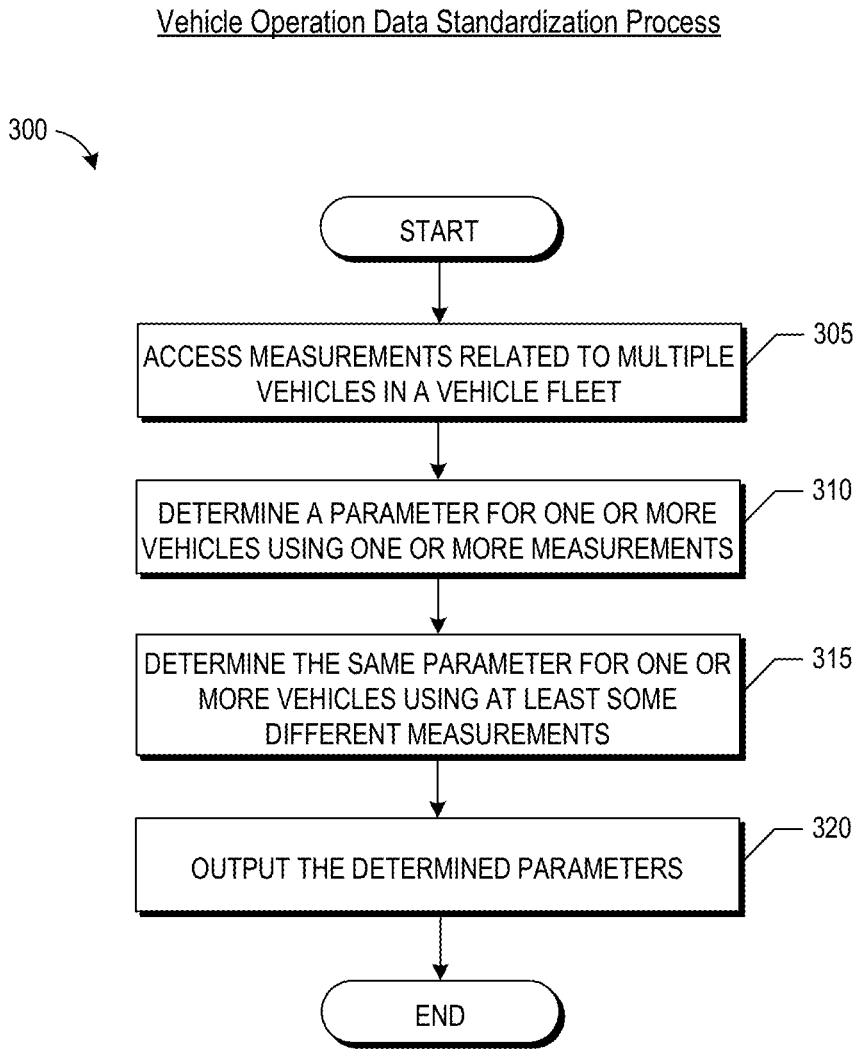
FIG. 3 illustrates an embodiment of a process for standardizing vehicle operation data.

FIG. 3 illustrates an embodiment of a process 300 for standardizing vehicle operation data. The process 300 can be performed, for example, by the data standardizing module 134 alone or in combination with one or more other modules of the vehicle management system 110 or in-vehicle devices 104. More generally, the process 300 can be implemented by any computer hardware and/or software. The process 300 can be performed for any number of vehicles, such as (for example) hundreds or thousands of vehicles in a vehicle fleet to determine standardized information for the vehicles of the vehicle fleet.

At block 305, the data standardizing module 134 accesses measurements related to multiple vehicles in a vehicle fleet. The measurements can include data such as location or speed information obtained using GPS or cellular tower triangulation (or other methods), vehicle sensor or diagnostic data, solid-state inertial information, or any other data that can be obtained from a vehicle, its engine, or the like. The measurements can be accessed from the telematics module 132.

At block 310, the data standardizing module 134 determines a parameter for one or more vehicles of the multiple vehicles in the vehicle fleet using one or more measurements. For example, a distance traveled for one vehicle can be estimated using odometer measurements from the engine computer of the one vehicle.

At block 315, the data standardizing module 134 determines the same parameter for one or more vehicles of the multiple vehicles using at least some different measurements. Continuing example of the previous paragraph, a distance traveled for the same vehicle or a different vehicle can be estimated using GPS position data provided by the in-vehicle devices 104 associated with the vehicles.

At block 320, the data standardizing module 134 outputs the determined parameters. Continuing example of the previous two paragraphs, the estimated distance traveled for the one or more vehicles can be output to the fleet management module 126, for instance, for storage or presentation to a user.

IX. Example Measurement Data Configuration Process

Figure 4:
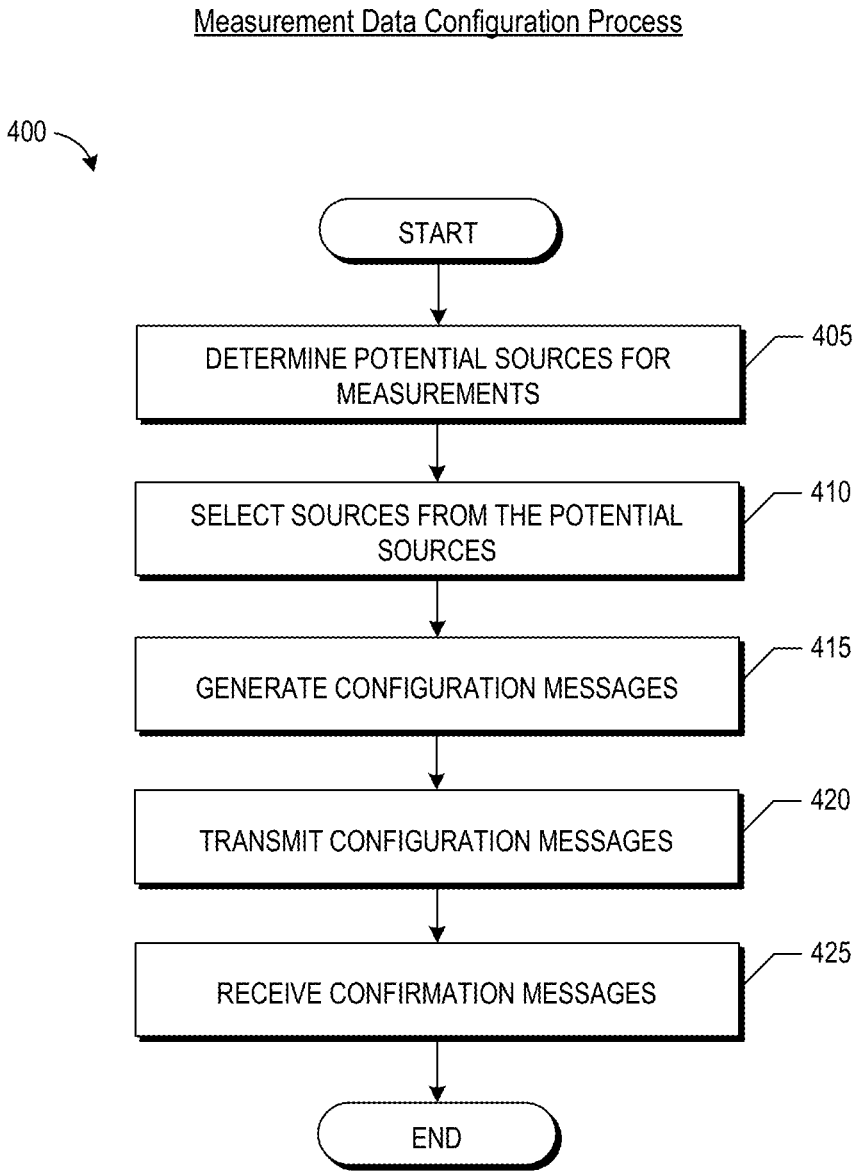
FIG. 4 illustrates an embodiment of a process for configuring the collection of measurement data from an in-vehicle device.

FIG. 4 illustrates an embodiment of a process 400 for configuring the collection of measurement data from an in-vehicle device. The process 400 can be performed, for example, by the measurement selection module 136 alone or in combination with one or more other modules of the vehicle management system 110 or in-vehicle devices 104. More generally, the process 400 can be implemented by any computer hardware and/or software. The process 400 can be performed for any number of vehicles, such as (for example) hundreds or thousands of vehicles in a vehicle fleet to configure the collection of measurement data from the in-vehicle devices 104.

At block 405, the measurement selection module 136 determines potential sources for measurements to determine a uniform set of parameters for multiple vehicles in a vehicle fleet. At block 410, the measurement selection module 136 selects one or more sources from the potential sources for vehicle operation measurements to use to determine the uniform set of parameters for the multiple vehicles. Measurement selection module 136 can rely in one or more criteria to make this election as described above.

At block 415, the measurement selection module 136 generates configuration messages for the in-vehicle devices 104 to instruct regarding the selected sources and measurements for the in-vehicle devices 104 and associated vehicles. A configuration message can comprise one or more data packets including multiple fields, such as one or more of a message type ID field (e.g., indicating the message is a configuration message), an in-vehicle device ID field (e.g., indicating the intended recipient in-vehicle device ID), a vehicle ID field (e.g., indicating the intended recipient vehicle ID), a selected sources field (e.g., indicating one or more sources selected by the measurement selection module 136), and a selected measurements field (e.g., indicating one or more measurements select by the measurement selection module 136). At block 420, the vehicle management system 110 transmits the configuration messages to the in-vehicle devices 104. At block 425, in response to the configuration messages, the vehicle management system 110 receives confirmation messages from the in-vehicle devices 104 indicating whether the configuration messages have been successfully received and processed. When the vehicle management system 110 does not receive one or more confirmation messages in response to transmitted configuration messages, the vehicle management system 110 can determine that the one or more configuration messages were not successfully received by the in-vehicle devices 104.

X. Example Standardized Vehicle Operation Information User Interface

Figure 5:
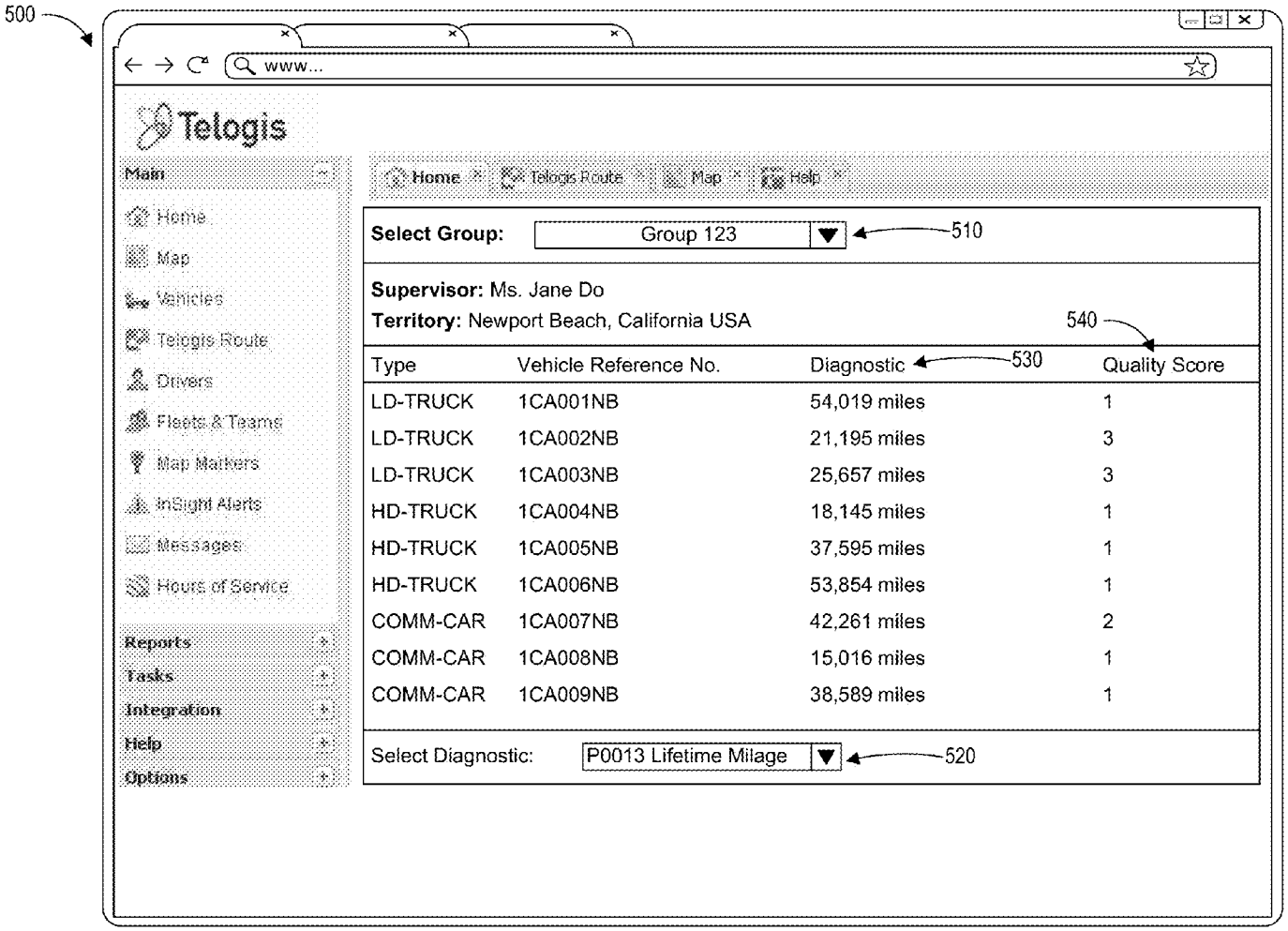
FIG. 5 illustrates an embodiment of a user interface display for outputting standardized vehicle operation information.

FIG. 5 illustrates an embodiment of a user interface display 500 for outputting standardized vehicle operation information. The user interface 500 can be displayed by the fleet management module 126, for instance. The user interface 500 can enable selection of a group 510 of vehicles from a vehicle fleet and selection of a uniform diagnostic 520 to display for the selected group 510. In the illustrated example, the uniform diagnostic of "Lifetime Mileage" is shown for the "Group 123."

As can be seen under diagnostic 530, the lifetime mileage is shown for nine example vehicles of the selected group 510. The nine example vehicles include three different types of vehicles, such as light-duty truck (LD-TRUCK), heavy-duty truck (HD-TRUCK), and commuter car (COMM-CAR). The nine example vehicles can have different reporting capabilities, as well as different available measurements at different times. Although lifetime mileages for the nine example vehicles may have been determined using one or more different measurements, the standardized presentation of information via the user interface 500 can facilitate review of meaningful vehicle operation information while relieving a user of the burden of considering the one or more sources of the measurements used to determine the information.

As can be seen under quality score 540, the diagnostics 530 can have one or more corresponding quality score values. Each quality score value, in turn, can correspond to a quality of a diagnostic (e.g., such as accuracy, reliability, precision, or the like). In the illustrated example, a quality score of 1 can correspond to the highest quality diagnostic, such as having the greatest accuracy, while a quality score of 2 can correspond to a lower quality, and a quality score of 3 corresponds to the lowest quality of the scores. Further, the quality score of one can correspond to particular measurements or sources of measurements for the diagnostic 530. In one further example, the quality score of 1 can indicate that the diagnostic is from the lifetime mileage provided by an engine computer of a vehicle. The quality score of 2 can indicate that the lifetime mileage was determined using GPS position information for the vehicle. The quality score of 3 can indicate that the lifetime mileage was manually entered by a driver of the vehicle (e.g., potentially infrequently).

The vehicle management system 110 can determine multiple estimates of the diagnostic 530 for one or more vehicles in some cases. In such cases, the vehicle management system can select or determine the diagnostic 530 to present for the one or more vehicles based on one or more criteria, including a quality or accuracy of the measurements used to prepare the estimates or a recency of the determined estimates. For some customers at certain times, recency can be the most important factor and thus used to select the presented estimate. For some customers at other times, accuracy can be the most important factor and thus used to select the presented estimate. For some customers at yet other times, the combination of factors including recency and accuracy are weighted to determine the presented estimate. In one example, an odometer measurement can be relied on as an accurate measurement of distance traveled by the vehicle every hour. However, at off-hour times, the distance traveled can instead be calculated according to the GPS position of the vehicle by updating to the latest odometer measurement.

XI. Additional Embodiments

The vehicle management system 110 can include a number of features that enable fleets of vehicles or mobile units to be managed in a dynamic environment. Fleets of vehicles can be used to make deliveries, to support service calls, and to move personnel from place to place. Delivery vehicles typically take on a load from a depot and make deliveries to a number of customers in a limited region. Long distance deliveries are typically handled by long haul trucks of various types. They are typically point-to-point over hundreds of miles and may have a single destination or multiple destinations. Single destination deliveries may include containers that are offloaded from ocean based shipping vessels or from factories to depots or loading docks. Short distance delivery vehicles can have multiple destination loads. The loads can be assembled at a warehousing depot and delivered to customers or outlets in a series of multiple stops. Service call applications can be short haul multiple-stop, with variable 'dwell' times. Service may involve providing inventory or parts as well as service labor which may be performed by one or more people. Typical service calls (stops) can be made to perform maintenance and supply disposable inventory.

The characteristics of these types of fleet applications can be summarized as a list with each variable annotated in time, such as the following Data Vector List that may be stored in a database or other data store: [Vehicle, location, driver, depot, inventory list, delivery stop list, vehicle fuel, vehicle capacity, vehicle condition, route and schedule, loading time, stop and delivery time for each scheduled stop, status (e.g., not started, route in process, at service stop, route completed, stopped at terminal)]. The timeline can include the temporal state or condition associated with a single vehicle. Note that each of the variables could have an extended time history. For example, the inventory could have a time history associated with its ('time of conception, birth, ageing, and death'). So the current span of the state can be a 'window' of the total variable state.

The main fleet dependent characteristics can include the vehicle ID and the vehicle location, for example, as a function of time. When the vehicle is manufactured, ('comes into being'), its ID (e.g., serial number) may be known. When it becomes part of a fleet, its 'entry' can be recorded as a date, and it may be assigned other types of identifying characteristics including a license number/registration etc. From this 'vector of temporal existence', one can trace the complete history of a vehicle including fueling, speed, diagnostic information, drivers who have driven the vehicle, etc. In a similar fashion, history vectors of where the vehicle has been, its inventory, etc. may be kept and added to during the interval that the inventory, driver, tires, etc. are associated with the vehicle.

Telematics data, optionally supplemented by other data, can be used describe the history and to manage a single vehicle or multiple vehicles. By accessing some or all of the 'data vectors', a comprehensive tracking and management system for assets (including, e.g., vehicles, loads, maintenance), personnel, and/or inventory can developed. In addition to recommended (scheduled) maintenance based on time and miles travelled, maintenance can also be based on additional information such as frequent hard braking, number of stops/starts, etc. In one embodiment, the vehicle management system 110 can generate a maintenance plan that is based on normal scheduled maintenance and additionally includes maintenance that is based on analyzing multiple vehicle records over time. These records can be used to project cause-effect events which lead to a necessary but non-scheduled maintenance event.

XII. Terminology

A number of computing systems have been described throughout this disclosure. The descriptions of these systems are not intended to limit the teachings or applicability of this disclosure. For example, the user systems described herein can generally include any computing device(s), such as desktops, laptops, video game platforms, television set-top boxes, televisions (e.g., internet TVs), computerized appliances, and wireless mobile devices (e.g. smart phones, PDAs, tablets, or the like), to name a few. Further, it is possible for the user systems described herein to be different types of devices, to include different applications, or to otherwise be configured differently. In addition, the user systems described herein can include any type of operating system ("OS"). For example, the mobile computing systems described herein can implement an Android™ OS, a Windows® OS, a Mac® OS, a Linux or Unix-based OS, or the like.

Further, the processing of the various components of the illustrated systems can be distributed across multiple machines, networks, and other computing resources. In addition, two or more components of a system can be combined into fewer components. For example, the various systems described herein can be distributed across multiple computing systems, or combined into a single computing system. Further, various components of the illustrated systems can be implemented in one or more virtual machines, rather than in dedicated computer hardware systems. Likewise, the data repositories shown can represent physical and/or logical data storage, including, for example, storage area networks or other distributed storage systems. Moreover, in some embodiments the connections between the components shown represent possible paths of data flow, rather than actual connections between hardware. While some examples of possible connections are shown, any of the subset of the components shown can communicate with any other subset of components in various implementations.

Depending on the embodiment, certain acts, events, or functions of any of the algorithms, methods, or processes described herein can be performed in a different sequence, can be added, merged, or left out all together (e.g., not all described acts or events are necessary for the practice of the algorithms). Moreover, in certain embodiments, acts or events can be performed concurrently, e.g., through multi-threaded processing, interrupt processing, or multiple processors or processor cores or on other parallel architectures, rather than sequentially.

Each of the various illustrated systems may be implemented as a computing system that is programmed or configured to perform the various functions described herein. The computing system may include multiple distinct computers or computing devices (e.g., physical servers, workstations, storage arrays, etc.) that communicate and interoperate over a network to perform the described functions. Each such computing device typically includes a processor (or multiple processors) that executes program instructions or modules stored in a memory or other non-transitory computer-readable storage medium. The various functions disclosed herein may be embodied in such program instructions, although some or all of the disclosed functions may alternatively be implemented in application-specific circuitry (e.g., ASICs or FPGAs) of the computer system. Where the computing system includes multiple computing devices, these devices may, but need not, be co-located. The results of the disclosed methods and tasks may be persistently stored by transforming physical storage devices, such as solid state memory chips and/or magnetic disks, into a different state. Each process described may be implemented by one or more computing devices, such as one or more physical servers programmed with associated server code.

Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment. The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list. In addition, the articles "a" and "an" are to be construed to mean "one or more" or "at least one" unless specified otherwise.

Conjunctive language such as the phrase "at least one of X, Y and Z," unless specifically stated otherwise, is otherwise understood with the context as used in general to convey that an item, term, etc. may be either X, Y or Z. Thus, such conjunctive language is not generally intended to imply that certain embodiments require at least one of X, at least one of Y and at least one of Z to each be present.

While the above detailed description has shown, described, and pointed out novel features as applied to various embodiments, it will be understood that various omissions, substitutions, and changes in the form and details of the devices or algorithms illustrated can be made without departing from the spirit of the disclosure. Thus, nothing in the foregoing description is intended to imply that any particular feature, characteristic, step, module, or block is necessary or indispensable. As will be recognized, the processes described herein can be embodied within a form that does not provide all of the features and benefits set forth herein, as some features can be used or practiced separately from others. The scope of protection is defined by the appended claims rather than by the foregoing description.

What is claimed is:

1. A system for presenting fleet vehicle operation information in standardized forms to a manager of vehicles in a fleet of vehicles, the system comprising:

a computer system comprising computer hardware configured to:

receive vehicle telematics data for a plurality of vehicles in a fleet of vehicles, the vehicle telematics data comprising measurements related to operation of the plurality of vehicles including a first vehicle and a second vehicle, the first vehicle having different measurement reporting capabilities from the second vehicle such that the first vehicle is capable of providing a set of the measurements that the second vehicle is incapable of providing;

estimate a first value for a parameter for the first vehicle using the set of the measurements that the second vehicle is incapable of providing, the parameter being indicative of vehicle performance information;

estimate a second value for the parameter for the second vehicle using the measurements and without using the set of the measurements that the second vehicle is incapable of providing; and output the first value and the second value to a display; and the display configured to present the first value and the second value together to a manager of the plurality of vehicles.

2. The system of claim 1, wherein the computer system comprising computer hardware is configured to estimate a third value for the parameter for the first vehicle using at least some of the measurements not used to estimate the first value.

3. The system of claim 2, wherein the computer system comprising computer hardware is configured to repeatedly determine the first value and the third value such that the first value is determined more frequently than the third value.

4. The system of claim 2, wherein the data computer system comprising computer hardware is configured assign a first quality value to the first value based at least on the measurements used to estimate the first value and assign a second quality value to the third value based at least on the measurements used to estimate the third value.

5. The system of claim 4, wherein the computer system comprising computer hardware is configured to select one of the first value and the third value for presentation to the manager based at least on whether the first quality value or the second quality value is greater.

6. The system of claim 4, wherein the computer system comprising computer hardware is configured to assign the first quality value further based on quality metrics associated with the measurements used to estimate the first value and assign the second quality value further based on quality metrics associated with the measurements used to estimate the third value.

7. The system of claim 1, wherein the computer system comprising computer hardware is configured to receive the measurements via a computer network from in-vehicle devices associated with the plurality of vehicles.

8. The system of claim 7, wherein the measurements comprise vehicle diagnostic data and global positioning system (GPS) data.

9. The system of claim 1, wherein the computer system comprising computer hardware is configured to estimate the first value further based on one or more previously estimated values for the parameter for the first vehicle.

10. The system of claim 1, wherein the computer system comprising computer hardware is configured to store to a memory the first value, the second value, the measurements used to estimate the first value, the measurements used to estimate the second value, and a first link between the first value and the measurements used to estimate the first value, and a second link between the second value and the measurements used to estimate the second value.

11. The system of claim 1, wherein the second vehicle is incapable of providing the set of the measurements due to design limitations of the second vehicle.

12. The system of claim 1, wherein the parameter comprises a distance traveled in a time period.

13. The system of claim 1, wherein the parameter comprises a number of hours that a vehicle engine has been turned on.

14. A method for presenting fleet vehicle operation information in standardized forms to a manager of vehicles in a fleet of vehicles, the method comprising:

accessing vehicle telematics data for a plurality of vehicles in a fleet of vehicles, the vehicle telematics data comprising measurements related to operation of the plurality of vehicles including a first vehicle and a second vehicle, the first vehicle having different measurement reporting capabilities from the second vehicle such that the first vehicle is designed to output a first set of the measurements and the second vehicle is designed to output a second set of the measurements other than the first set of the measurements;

estimating a first value for a parameter for the first vehicle using the first set of the measurements, the parameter being indicative of vehicle performance information;

estimating a second value for the parameter for the second vehicle using the second set of the measurements and without using the first set of the measurements;

outputting the first value and the second value to a display; and presenting the first value and the second value together on the display to a manager of the plurality of vehicles, wherein the method is performed by a computer system comprising computer hardware.

15. The method of claim 14, further comprising:

selecting the measurements used for estimating the first value based at least on a vehicle type of the first vehicle; and selecting the measurements used for estimating the second value based at least on a vehicle type of the second vehicle, the vehicle type of the first vehicle being different from the vehicle type of the second vehicle.

16. The method of claim 15, wherein said selecting the measurements used for estimating the first value comprises selecting the measurements used for estimating the first value further based on a first in-vehicle device used to determine the measurements, an amount of data used to store the measurements used for estimating the first value, and an accuracy of the first value.

17. The method of claim 15, further comprising generating and transmitting a first configuration message to a first in-vehicle device associated with the first vehicle and a second configuration message to a second in-vehicle device associated with the second vehicle, the first configuration message instructing the first in-vehicle device to determine one or more of the measurements for the first vehicle, the second configuration message instructing the second in-vehicle device to determine one or more of the measurements for the second vehicle.

18. The method of claim 15, wherein said selecting the measurements used for estimating the first value comprises selecting the measurements used for estimating the first value using a dependency tree, the dependency tree organizing and ranking at least some of the measurements usable to estimate the parameter.

19. Non-transitory physical computer storage comprising instructions stored thereon for implementing, in one or more processors, a method for presenting fleet vehicle operation information in standardized forms to a manager of vehicles in a fleet of vehicles, the method comprising:

accessing vehicle telematics data for a plurality of vehicles in a fleet of vehicles, the vehicle telematics data comprising measurements related to operation of the plurality of vehicles including a first vehicle and a second vehicle, the first vehicle having different measurement reporting capabilities from the second vehicle such that the first vehicle is designed to output a first set of the measurements and the second vehicle is designed to output a second set of the measurements other than the first set of the measurements;

estimating a first value for a parameter for the first vehicle using the first set of the measurements, the parameter being indicative of vehicle performance information;

estimating a second value for the parameter for the second vehicle using the second set of the measurements and without using the first set of the measurements;

outputting the first value and the second value to a display; and presenting the first value and the second value together on the display to a manager of the plurality of vehicles.

20. The non-transitory physical computer storage of claim 19, wherein said estimating the first value comprises estimating the first value for at least one hundred vehicles of the plurality of vehicles including the first vehicle, and wherein said estimating the second value comprises estimating the second value for at least one hundred vehicles of the plurality of vehicles including the second vehicle.

* * * * *

UNITED STATES PATENT AND TRADEMARK OFFICE

CERTIFICATE OF CORRECTION

PATENT NO. : 9,014,876 B2
APPLICATION NO. : 13/921036
DATED : April 21, 2015
INVENTOR(S) : Mason et al.

It is certified that error appears in the above-identified patent and that said Letters Patent is hereby corrected as shown below:

Claims

In column 25 at line 12, In Claim 4, change “data computer” to --computer--.

Signed and Sealed this
Ninth Day of February, 2016

Michelle K. Lee

Michelle K. Lee
*Director of the United States Patent and Trademark Office*